US010753612B2

(12) United States Patent
Heinze

(10) Patent No.: US 10,753,612 B2
(45) Date of Patent: Aug. 25, 2020

(54) PLATE-SHAPED STRUCTURAL COMPONENT OF A GAS TURBINE

(71) Applicant: Rolls-Royce Deutschland Ltd & Co KG, Blankenfelde-Mahlow (DE)

(72) Inventor: Kay Heinze, Ludwigsfelde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 258 days.

(21) Appl. No.: 15/833,471

(22) Filed: Dec. 6, 2017

(65) Prior Publication Data

US 2018/0163964 A1 Jun. 14, 2018

(30) Foreign Application Priority Data

Dec. 9, 2016 (DE) ..... 10 2016 224 632

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F05D 2260/22141* (2013.01); *F23R 2900/00018* (2013.01); *F23R 2900/03041* (2013.01)

(58) Field of Classification Search
CPC .... F23R 3/00; F23R 3/002; F23R 3/06; F23R 3/005; F23R 3/60; F23R 2900/03041; F23R 2900/03042; F23R 2900/03043; F23R 2900/00018; F01D 25/12; F01D 25/14; F01D 9/023; F05D 2260/2214; F05D 2260/22141; F05D 2240/122;
(Continued)

(56) References Cited

U.S. PATENT DOCUMENTS 4,622,821 A * 11/1986 Madden ..... F23R 3/06 60/755
5,209,067 A * 5/1993 Barbier ..... F23R 3/06 60/757

(Continued)

FOREIGN PATENT DOCUMENTS

EP 1022437 A1 7/2000
EP 2873921 A1 5/2015

(Continued)

OTHER PUBLICATIONS

German Search Report dated Aug. 9, 2017 for counterpart German Application No. DE102016224632.1.

(Continued)

*Primary Examiner* — Alain Chau
(74) *Attorney, Agent, or Firm* — Shuttleworth & Ingersoll, PLC; Timothy J. Klima

(57) ABSTRACT

A plate-shaped structural component of a gas turbine with a base body that, at least in one edge area, is provided in one piece with a side bar that is embodied to ne substantially rectangular to the surface of the base body, wherein the base body has a different thickness than the side bar, wherein a supporting body, which is connected in one piece with the base body and the side bar and is provided with a substantially triangular cross section, is arranged between the side bar and the base body, being provided with multiple slit-like recesses.

14 Claims, 3 Drawing Sheets

Figure 1:
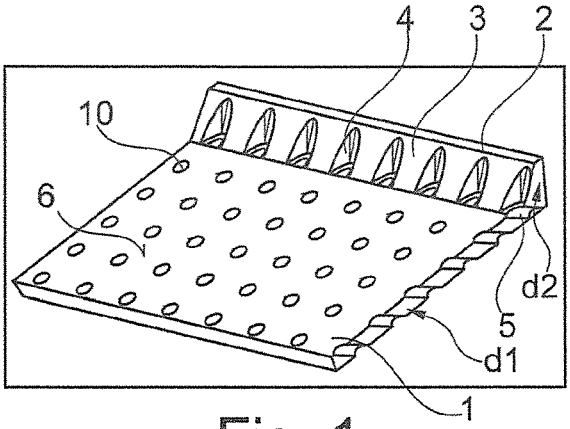

(58) Field of Classification Search
CPC ..... F05D 2240/125; F05D 2240/304; F05D 2240/307; F23M 5/02; F23M 5/08; F23M 5/085
See application file for complete search history.

(56) References Cited

U.S. PATENT DOCUMENTS

| | | | | |
|---|---|---|---|---|
| 6,032,457 | A * | 3/2000 | McKinney | F23R 3/10 60/740 |
| 6,609,891 | B2 * | 8/2003 | Leeke | F01D 5/186 415/115 |
| 7,270,514 | B2 * | 9/2007 | Lee | B23P 6/007 416/92 |
| 7,681,398 | B2 * | 3/2010 | Patel | F02C 3/145 60/752 |
| 7,980,821 | B1 * | 7/2011 | Liang | F01D 5/187 416/96 R |
| 9,719,357 | B2 * | 8/2017 | Moody | F01D 5/186 |
| 10,041,675 | B2 * | 8/2018 | Lebel | F23R 3/06 |
| 10,174,947 | B1 * | 1/2019 | Clemen | F23M 5/02 |
| 2004/0083735 | A1 * | 5/2004 | Borns | F23R 3/10 60/772 |
| 2008/0127652 | A1 | 6/2008 | Putz | |
| 2008/0264065 | A1 * | 10/2008 | Gerendas | F23R 3/007 60/754 |
| 2008/0314044 | A1 * | 12/2008 | Bronson | F23R 3/10 60/754 |
| 2011/0197590 | A1 * | 8/2011 | Bottcher | F23R 3/002 60/752 |
| 2013/0333388 | A1 * | 12/2013 | Polisetty | F23R 3/002 60/752 |
| 2014/0271131 | A1 * | 9/2014 | Moody | F01D 5/186 415/116 |
| 2015/0128602 | A1 * | 5/2015 | Clemen | F23R 3/002 60/754 |
| 2015/0260400 | A1 * | 9/2015 | Clemen | F23R 3/60 60/722 |
| 2015/0354818 | A1 * | 12/2015 | Lebel | F02C 7/28 60/796 |
| 2016/0238247 | A1 | 8/2016 | Staufer | |
| 2016/0258626 | A1 * | 9/2016 | Moura | F23R 3/005 |

FOREIGN PATENT DOCUMENTS

| | | | |
|---|---|---|---|
| EP | 2927592 | A1 | 10/2015 |
| EP | 3056813 | A1 | 8/2016 |
| WO | WO2006064038 | A1 | 6/2006 |
| WO | WO2015069466 | A1 | 5/2015 |
| WO | WO2016016280 | A1 | 2/2016 |
| WO | WO2016062581 | A1 | 4/2016 |

OTHER PUBLICATIONS

European Search Report dated Apr. 26, 2018 for counterpart European Patent Application No. 17205686.3.

* cited by examiner

PLATE-SHAPED STRUCTURAL COMPONENT OF A GAS TURBINE

The invention relates to a plate-shaped structural component of a gas turbine according to the features of the generic term of claim 1.

The invention also relates to a gas turbine with a plate-shaped structural component.

Specifically, the invention relates to a plate-shaped structural component, which may for example be embodied in the form of a combustion chamber shingle. The plate-shaped structural component has a base body at which at least one edge area is provided. This edge area is embodied in the form of a side bar which substantially extends to the surface of the base body. Further, the side bar has a thickness that is different from the thickness of the base body. Usually, the side bar is embodied with a larger thickness than the base body itself.

Such a plate-shaped structural component in the form of a combustion chamber shingle is already known from WO 2015069466 A1. Further, EP 2 873 921 A1 is referred to.

Structural components of the described kind are preferably manufactured by means of an additive manufacturing method, for example by means of a laser deposition welding method or by means DLD direct laser deposition. At that, the respective structural component is constructed layer by layer from a powder supply by melting the powder. This results in a local hardening of the respective molten layer. In this manner, complex 3D geometries can be created.

Depending on the orientation direction of the structural component during manufacturing, geometrical variations of the thickness of the structural component can lead to stresses and cracks in the course of the manufacturing process already during the melting procedure. High residual stresses may build up in the structural component, which may lead to a failure of the structural component. To avoid such strong transitions of the respective structural component thicknesses or structural component volumes, it is known to use support structures that lead to a smaller gradient in structural component thickness variation. Such support structures either lead to locally enlarged volume areas of the structural components or have to be subsequently removed. In the first case, the enlarged structural component volumes are problematic with respect to the cooling of the structural component, for example in a combustion chamber shingle. For one thing, a subsequent removal of the support structures is elaborate from the production technological point of view, and, for another, does not ensure that [no] high residual stresses, which may lead to cracks, have been created already during manufacture.

The invention is based on the objective to create a plate-shaped structural component, in particular for a gas turbine, in particular in the form of a combustion chamber shingle, which avoids the disadvantages of the state of the art and has advantageous material characteristics while at the same time having a simple structure and a simple, cost-effective manufacturability.

According to the invention, the objective is achieved by means of a combination of features of claim 1, with the subclaims showing further advantageous embodiments of the invention.

According to the invention it is thus provided that, between the side bar and the base body, a supporting body that is connected in one piece with the base body and the side bar is arranged, which has a substantially triangular cross section and which is provided with multiple slit-like recesses. Through the supporting body according to the invention, which is arranged between the base body and the side bar, what results with a usually vertical orientation of the base body during the additive manufacturing method is an increasing transition from the wall thickness of the base body to the side bar or in reverse. Sudden geometrical variations, that can lead to residual stresses and crack formations, are thus avoided.

What is more, the supporting body according to the invention has a plurality of slit-like recesses, so that what results is a substantially rib-like shape of the supporting body. In total, with a suitable dimensioning, this leads to low material accumulation at the transition between the base body to the side bar. In this manner, not only the occurrence of voltage peaks is avoided, but also the possibility of an effective cooling is created. The latter is facilitated in particular by the fact that at least one cooling air hole is embodied in the respective slit-like recess.

Preferably, respectively one cooling air hole penetrating the base body is arranged inside every slit-like recess.

The structural component according to the invention is in particular suitable for the use with brittle materials that have high requirements with respect to the stress distribution and the material strength.

What is this created according to the invention is a transition between structural components having different thicknesses or different volumes that facilitates manufacturing the structural component by means of an additive manufacturing method. The individual slit-like recesses can be geometrically designed in a suitable manner. The same applies to the preferred implementation of the cooling air holes. It is to be understood that the width of the recesses as well as the respective remaining width of the areas of the supporting body between the recesses can also be adjusted to the structural component geometries, just like the dimensioning and geometry of the cooling air hole. It is also possible to provide multiple cooling air holes in a recess.

In an additive construction of the shingle, the strip-shaped areas of the supporting body remaining between the recesses lead to a reduction of the residual stresses along the longitudinal side of the shingle. As mentioned, the occurrence of residual stresses can be avoided in this way in particular with brittle materials. In this way, the danger of crack formation is considerably reduced.

Since according to the invention at least one cooling air hole is preferably provided in each one of the slit-like recesses, the plate-shaped structural component according to the invention can be optimized with respect to cooling. What is additionally provided thanks to the additive manufacturing method is the possibility to design cooling holes differently across their length, for example to change their cross section. As a result of all of this, a sufficient cooling air volume can be guided at the back side of the base body of the plate-shaped structural component that is arranged opposite the side bar. Thanks to the option of designing cooling holes variably in their longitudinal extension, also arc-shaped or spiraled or coiled shapes of cooling air holes can be realized. This results in a more effective cooling.

It is further preferred if the plate-shaped structural component has additional cooling air holes that extend through the side bar, beginning at the slit-shaped recess. Accordingly, the additional cooling air holes are side air holes which guide cooling air outwards out of the recess through the side bar. In the through-flow direction, the additional cooling air holes can preferably have a widening cross section, in particular a conically widening cross section. In this way, the additional cooling air holes act as a diffusor. Here, it is particularly preferred if the smallest cross section of the additional cooling air hole is present at the entry into the side bar, or adjacent to the entry into the side bar, i.e. within a range of 10% of a total length of the additional cooling air hole through the side bar.

Thus, cooling in the area of the side bar of the plate-shaped structural component can be realized exclusively through the slit-shaped recesses, or through the cooling air holes that are formed in the base body of the plate-shaped structural component, or through additional cooling air holes that are formed in the side bar of the plate-shaped structural component, or through a combination of the additional cooling air holes through the side bar and the cooling air holes through the base body. Thus, variants with a small cooling air hole at the recess, a cooling air hole in the side bar or the base body, or two cooling air holes in the side bar and the base body may be used.

In a particularly advantageous embodiment of the invention it is provided that the recess is embodied to be symmetrical to the central plane of the cooling air hole. This results in even stress distributions in the area of the recess and the adjoining areas of the supporting body. Further, the supply of cooling air into the cooling air hole is optimized.

The slit-like recesses of the supporting body can be embodied in such a manner in an advantageous embodiment of the invention, that the walls of the recess adjoining the surface of the base body at first have a rectilinear wall course on both sides, then transitioning into a rounded-off wall course in the upper area of the slit-like recess for forming a ogival structure. Here, it is particularly advantageous if the rounded-off wall course has a radius that is between 0.1 times to 2 times, in particular 1 to 2 times, the width of the recess. In a particularly advantageous further development it is provided that the rounded-off wall courses form an angle of between 45° and 120°. In this manner, the contour of the recesses, which is ogival in the side view, is realized in a particularly effective manner.

In the longitudinal direction of the side bar, the distance of adjacent recesses can be larger than or equal to half the width of the recesses. What is thus provided in an alternating manner along the side bar are recesses of substantially the same width and remaining chamfer-like areas of the supporting body.

With respect to its surface, the supporting body itself, forming a chamfer-like transition between the base body and the side bar, can have an angle to the surface of the base body of between 30° and 60°. Here, a value of 45° is preferable.

Further, it is possible according to the invention to arrange the central axis of the cooling air hole to be rectangular or to be positioned at an obtuse angle to the surface of the base body, i.e. in a range of 90° to 180°. In this manner, preferable cooling effects, in particular in those areas of the side bar or of the base body that are subject to strong thermal stresses, can be obtained.

Figure 2:
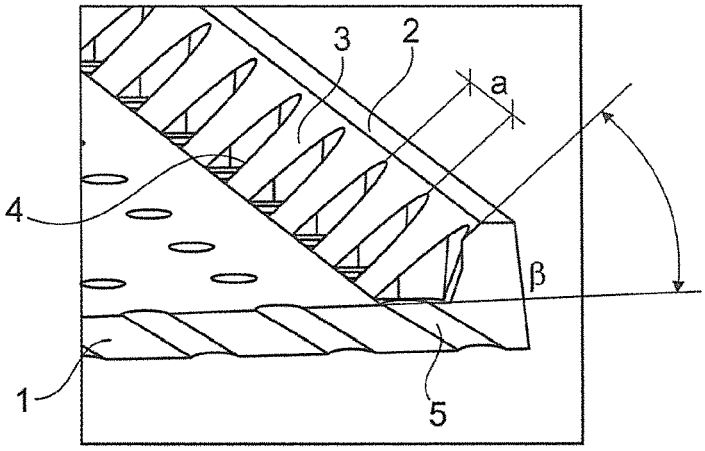
Figure 3:
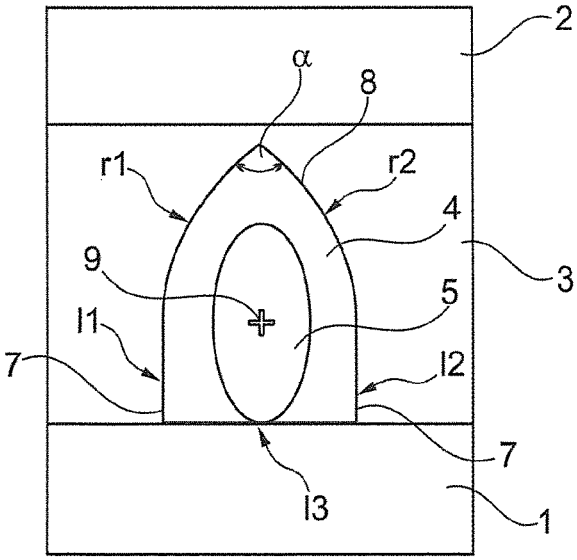
Figure 4:
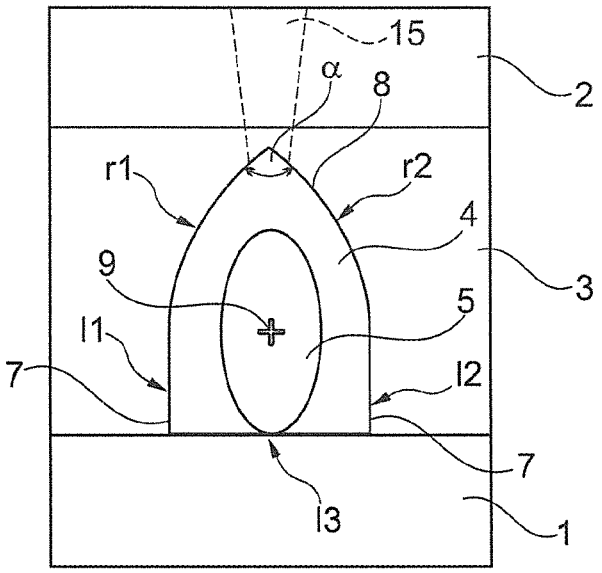
Figure 5:
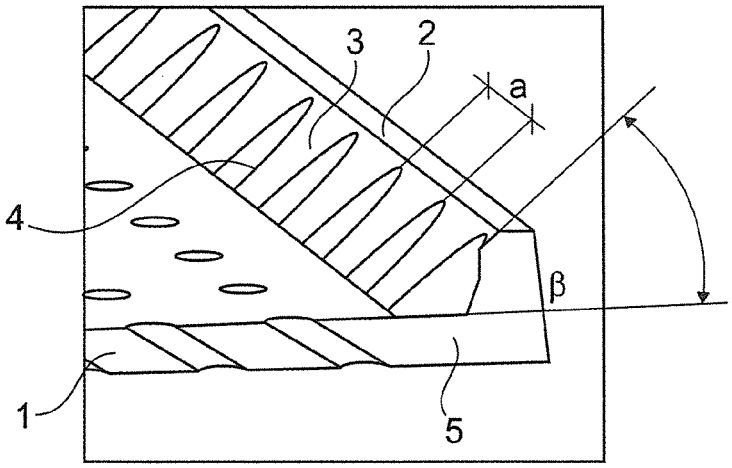
Figure 6:
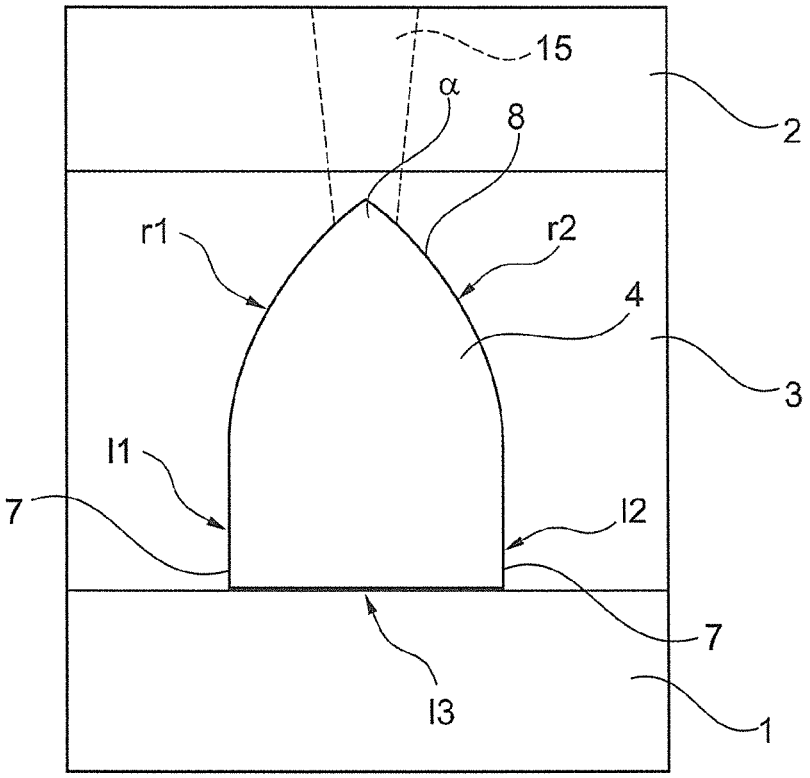

In the following, the invention is described based on the exemplary embodiment in connection with the drawing. Herein:

FIG. 1 shows a schematic perspective partial view of a first exemplary embodiment of the invention, FIG. 2 shows a perspective side view according to FIG. 1, FIG. 3 shows a simplified top view according to FIG. 1 or 2, FIG. 4 shows a schematic top view of a second exemplary embodiment of the invention, FIG. 5 shows a schematic perspective side view of a third exemplary embodiment of the invention, and FIG. 6 shows a schematic perspective top view of a fourth exemplary embodiment of the invention.

FIG. 1 shows, in a perspective rendering and in a partial view, a first exemplary embodiment of a plate-shaped structural component according to the invention, which is embodied in the form of a combustion chamber shingle of a gas turbine. The plate-shaped structural component has a base body 1 that is designed as an even plate. The base body 1 has a surface 6 that is facing away from a combustion chamber interior space of a gas turbine engine. Thus, the surface 6 represents the cold surface of the plate-shaped structural component (combustion chamber shingle).

A plurality of effusion cooling holes is embodied in the base body 1, as it is known from the state of the art.

The base body 1 has a thickness d1.

At the edge area of the base body 1, a side bar 2 is embodied in one piece with the same, having a thickness d2. The thickness d1 is measured from the surface 6 of the base body 1 to its back side. The thickness d2 of the side bar 2 is defined in the same direction.

The side bar 2, which is embodied in one piece with the base body 1 by means of an additive method, is supported by means of a supporting body 3. The latter has a substantially triangular cross section, as it follows from FIG. 2. Across its length, the supporting body is provided with a plurality of recesses 4. The areas of the supporting body 3 remaining between the recesses 4 are thus embodied in a bar-shaped or strip-shaped manner.

At least one cooling air hole 5 is provided in every recess 4, extending from the recess 4 to the back side of the base body 1 analog the effusion cooling holes 10.

The free surface of the supporting body 3 has an angle β with respect to the surface 6 of the base body 1, which can be between 30° and 60°. A value of 45° is preferable.

FIG. 3 shows a top view onto the arrangement according to FIGS. 1 and 2. Here, it can be seen that the recess 4 has a width l3. The side walls of the recess 4, which are identified as l1 and l2 in FIG. 3, respectively have a rectilinear wall course 7 and transition into a rounded-off wall course 8, the radius of which is respectively indicated by r1 and r2 in FIG. 3. The two rounded-off wall courses 8 meet at an angle α. It can be between 45° and 120°.

The length of the rectilinear wall courses 7 (l1 or l2) is preferably identical and ≥0 mm. The radiuses r1 and r2 are also identical and are 0.1 times to 2 times the width l3 of the recess 4.

The rectilinear wall courses 7 with the lengths l1 and l2 as well as the rounded-off wall courses 8 with the radiuses r1 and r2 are not mandatory for the invention, also other wall courses can be realized for forming the recess 4. The lengths l1 and l2 as well as the radiuses r1 and r2 can differ from each other in the specified intervals. Also, it is not mandatory that the recess 4 is arranged symmetrically to a central plane of the cooling air hole 5.

FIG. 3 shows the positioning of the cooling air hole 6 with its central axis 9. Accordingly, the structure of the recesses 4 and of the associated cooling air holes 5 is substantially symmetrical. The recesses 4 thus form a support structure that is defined by two rounded-off or arc-shaped wall areas between which the individual cooling air holes 5 are arranged.

The manufacture of the structural component according to the invention by means of an additives method is usually carried out with a vertical orientation of the base body 1. If the latter is provided with a side bar at all sides, a side bar with the thickness d2 is constructed first. The transition to the base body 1 with a thickness d1 is realized in a continuous manner through the respective supporting body 3, which is provided with the recesses 4.

It is to be understood that the structural component according to the invention can be provided with a side bar 2 at all its edges. Further, according to the invention, the plate-shaped base body 1 is not limited to an even plate, but can also be embodied so as to be curved or double-curved.

FIG. 4 shows, in a schematic manner, a simplified top view of a slit-like recess according to a second embodiment of the invention. The second embodiment substantially corresponds to the first embodiment, wherein in addition respectively one additional cooling air hole 15 is provided. The additional cooling air hole 15 extends from the slit-like recess 4 through the side bar 2 of the plate-like structural component, opening into the outer side of the side bar. Here, a flow cross section of the additional cooling air hole in the side bar 2 preferably changes. As shown in FIG. 4, the additional cooling air hole 15 is configured as the diffusor, wherein the narrowest cross section is located at the entry into the side bar 2. The additional cooling air hole 15 is preferably formed in a linear manner. However, it is to be understood that the additional cooling air hole 15 can also have a curved shape in the flow direction. Thus, in addition the side bar 2 can also be cooled through the additional cooling air hole 15. At that, the diffusor design of the additional cooling air hole 15 reduces the velocity of the cooling air, whereby a cooling effect can be increased.

FIG. 5 shows a fifth embodiment of the invention, which in contrast to the first embodiment has no cooling air holes 5 that are arranged at the slit-like recess 4. In this manner, an improved stability can be achieved in the area of the supporting body 3 and the side bar 2 of the combustion chamber shingle, which reduces the residual stress in the structural component, in particular if the shingle has an additive structure. By providing the plurality of slit-shaped recesses 4, it is still possible to achieve sufficient cooling of the supporting body 3 and the side bar 2.

FIG. 6 shows a fourth embodiment of the invention. The fourth embodiment substantially corresponds to the second embodiment, but in contrast to the second embodiment no cooling air holes 5 through the base body 1 arranged at the base of the recess 4 are provided. Thus, the slit-shaped recess 4 is cooled only by the additional cooling air holes 15 that extend though the side bar 2. The additional cooling air hole 15 through the side bar 2 is embodied as a diffusor, just like in the second embodiment. However, it is to be understood that other geometrical shapes can also be provided for the additional cooling air hole 15, for example a constant cross section across the flow length of the additional cooling air hole 15.

PARTS LIST

1 base body
2 side bar
3 supporting body
4 recess
5 cooling air hole
6 surface
7 rectilinear course
8 rounded-off course
9 central axis
10 effusion cooling hole
15 additional cooling air hole in the side bar
a distance between adjacent recesses d1 thickness of the base body
d2 thickness of the side bar
l1, l2 lengths of the linear wall shapes of the recess
l3 width of the recess at the base of the supporting body
r1, r2 radius of rounded wall shapes of the recess

The invention claimed is:

1. A plate-shaped structural component forming a gas turbine combustor shingle, comprising:

a base body including at least one edge area;

a side bar at the base body at the at least one edge area, wherein the side bar is perpendicular to a surface of the base body, and wherein the base body includes a different thickness than the side bar; and a supporting body arranged between the base body and the side bar;

wherein the supporting body includes a triangular cross section;

wherein the supporting body includes at least one recess, wherein at the at least one recess the supporting body includes a rectilinear wall course which transitions into a rounded-off wall course at each side of the at least one recess to form an ogival shape of the at least one recess; and a respective base cooling air hole penetrating the base body and arranged inside the at least one recess; and wherein the at least one recess includes a plurality of recesses.

2. The plate-shaped structural component according to claim 1, and further comprising a respective side cooling air hole extending from the at least one recess through the side bar.

3. The plate-shaped structural component according to claim 1, wherein the side cooling air hole includes a cross section that widens in a flow-through direction.

4. The plate-shaped structural component according to claim 3, wherein the cross section of the side cooling air hole conically widens.

5. The plate-shaped structural component according to claim 3, wherein a smallest cross section of the side cooling air hole is present in a least one chosen from at an entry into the side bar and adjacent to the entry into the side bar.

6. The plate-shaped structural component according to claim 1, wherein the at least one recess is symmetrical to a central plane of the base cooling air hole.

7. The plate-shaped structural component according to claim 1, wherein the rounded-off wall course includes a radius that is between 0.1 times to 2 times a width of the recess.

8. The plate-shaped structural component according to claim 7 wherein the rounded-off wall course includes a radius that is between 1 times to 2 times a width of the at least one recess.

9. The plate-shaped structural component according to claim 1, wherein the rounded-off wall course at each side of the at least one recess forms an angle at a top of the at least one recess of between 45° and 120°.

10. The plate-shaped structural component according to claim 1, wherein a distance between adjacent recesses of the plurality of recesses along a longitudinal direction of the side bar is one chosen from greater than and equal to l3×0.5, wherein l3 is a width of a respective one of the plurality of recesses.

11. The plate-shaped structural component according to claim 1, wherein the supporting body includes an angle of between 30 and 60° with respect to the surface of the base body.

12. The plate-shaped structural component according to claim 11, wherein the supporting body includes an angle of 45° with respect to the surface of the base body.

13. The plate-shaped structural component according to claim 1, wherein a central axis of the base cooling air hole is one chosen from perpendicular and at an obtuse angle to the surface of the base body.

14. A plate-shaped structural component forming a gas turbine combustor shingle, comprising:

a base body including at least one edge area;

a side bar at the base body at the at least one edge area, wherein the side bar is perpendicular to a surface of the base body, and wherein the base body includes a different thickness than the side bar; and a supporting body arranged between the base body and the side bar;

wherein the supporting body includes a triangular cross section;

wherein the supporting body includes at least one recess, wherein at the at least one recess the supporting body includes a rectilinear wall course which transitions into a rounded-off wall course at each side of the at least one recess to form an ogival shape of the at least one recess; and a respective side cooling air hole extending from the at least one recess through the side bar; and wherein the at least one recess includes a plurality of recesses.

* * * * *